US009511901B2

(12) United States Patent
Lam

(10) Patent No.: US 9,511,901 B2
(45) Date of Patent: Dec. 6, 2016

(54) DUAL COMPARTMENT PRODUCE CONTAINER HAVING TWO RECEPTACLES SEPARATED BY A BARRIER DEFINED BY OPPOSITELY ORIENTED WALLS OF EACH OF THE TWO RECEPTACLES

(71) Applicant: Multisteps Pty Ltd, Homebush West NSW (AU)

(72) Inventor: John Lam, Cherrybrook (AU)

(73) Assignee: Multisteps Pty Ltd, Homebush West NSW (AU)

( * ) Notice: Subject to any disclaimer, the term of this patent is extended or adjusted under 35 U.S.C. 154(b) by 0 days.

(21) Appl. No.: 14/467,963

(22) Filed: Aug. 25, 2014

(65) Prior Publication Data

US 2016/0016690 A1 Jan. 21, 2016

(30) Foreign Application Priority Data

Jul. 18, 2014 (AU) ..... 2014902789

(51) Int. Cl.
*B65D 25/04* (2006.01)
*B65D 85/34* (2006.01)
*B65D 43/16* (2006.01)

(52) U.S. Cl.
CPC ..... *B65D 25/04* (2013.01); *B65D 43/162* (2013.01); *B65D 85/34* (2013.01); *B65D 2205/00* (2013.01); *B65D 2543/00194* (2013.01); *B65D 2543/00296* (2013.01); *B65D 2543/00361* (2013.01); *B65D 2543/00537* (2013.01)

(58) Field of Classification Search
CPC ... A45C 11/20; A47G 19/065; A47G 19/2272; A47G 19/23; A47G 2019/122; B65D 1/36; B65D 5/4295; B65D 21/0212; B65D 25/04; B65D 25/107; B65D 43/16; B65D 43/161–43/162; B65D 43/0204; B65D 75/22; B65D 72/245; B65D 81/26; B65D 81/263; B65D 85/32; B65D 85/34; B65D 85/324; B65D 2205/00; B65D 2205/02; B65D 2251/1033; B65D 2543/00296; B65B 25/04; Y10S 220/913
USPC ..... 220/4.21–4.23, 366.1, 500, 507, 220/516–517, 608, 671, 675, 780, 788, 220/810, 834, 836, 839, 913; 206/508–509; 229/406, 229/902; D9/420, 423, 425–427; D7/629; D3/307
See application file for complete search history.

(56) References Cited

U.S. PATENT DOCUMENTS 3,131,846 A * 5/1964 Whiteford ..... B65D 85/324 206/521.8
3,372,812 A * 3/1968 Parcels ..... A47F 7/0057 206/445
3,633,785 A * 1/1972 Cyr ..... B65D 43/162 206/545
3,771,712 A * 11/1973 Richards ..... B65D 85/324 206/521.1
3,933,296 A * 1/1976 Ruskin ..... B65D 75/245 206/541

(Continued)

*Primary Examiner* — J. Gregory Pickett
*Assistant Examiner* — Brijesh V. Patel
(74) *Attorney, Agent, or Firm* — Alston & Bird LLP

(57) ABSTRACT

The present invention relates to a dual compartment produce container with a mouth circumscribed by a rim. The container includes first and second receptacles and a lid. The first receptacle is partially defined by a first wall. The second receptacle is partially defined a second wall. The lid is associated with the container to close off the mouth. The first and second walls are located opposite each other and joined at one end forming a barrier between the first and second receptacles.

15 Claims, 8 Drawing Sheets

(56) References Cited

U.S. PATENT DOCUMENTS 4,416,906 A * 11/1983 Watkins ..... B65D 81/3453 219/725
4,576,330 A * 3/1986 Schepp ..... B65D 43/162 220/315
4,653,685 A * 3/1987 Leary ..... B65D 1/36 220/4.21
D304,910 S * 12/1989 Natori ..... D9/681
5,322,182 A * 6/1994 Fritz ..... B65D 1/36 219/725
5,419,451 A * 5/1995 Bitel, Jr. ..... B65D 1/36 206/508
5,515,993 A * 5/1996 McManus ..... B65D 43/162 206/508
D420,584 S * 2/2000 Hopkins ..... D9/415
D433,592 S * 11/2000 Hopkins ..... D7/359
6,187,354 B1 * 2/2001 Hopkins ..... A23L 1/0128 219/734
D448,130 S * 9/2001 Wagner ..... D32/53.1
6,644,494 B2 * 11/2003 Hayes ..... B65D 21/0219 206/508
D514,452 S * 2/2006 Enriquez ..... D9/759
D528,014 S * 9/2006 Cutts ..... D9/761
D553,010 S * 10/2007 Cutts ..... D9/761
D592,076 S * 5/2009 Sipe ..... D9/420
D620,350 S * 7/2010 Hernandez ..... D9/425
D626,863 S * 11/2010 Lovett ..... D9/424
D651,922 S * 1/2012 Short ..... D9/737
D681,446 S * 5/2013 Schulter ..... D9/420
2009/0152158 A1 * 6/2009 Kidd ..... B65D 21/045 206/564

* cited by examiner

DUAL COMPARTMENT PRODUCE CONTAINER HAVING TWO RECEPTACLES SEPARATED BY A BARRIER DEFINED BY OPPOSITELY ORIENTED WALLS OF EACH OF THE TWO RECEPTACLES

CROSS-REFERENCE TO RELATED APPLICATION

This application claims priority to and the benefit of Australian Patent Application No. 2014902789, filed Jul. 18, 2014, which is hereby incorporated by reference in its entirety.

BACKGROUND

The present invention relates to a packaging container. More particularly, the present invention relates to a produce container with dual compartment.

DESCRIPTION OF RELATED ART

Produce growers and traders typically use produce containers to transport fresh produce from farms to distributors or wholesalers who on-sell the produce to retailers. The retailers would then put the containers full of produce on shelves for display.

Container manufacturers have made attempts to expand their product lines to include containers with multiple compartments such that consumers can buy a variety of items without having to buy an entire container of each item. Produce contained in the multi-compartment containers are advantageous in that they appeal to consumers looking for a medley of items but not needing huge amounts. For instance, containers which come in multi-compartment figurations are popular for retail offerings, such as a berry medley. Two or more kinds of berries, for example blueberries, raspberries or blackberries, can be put in the same pack. Multi-compartment containers have also seen utilization in the tomato industry with a mixed pack of two or more of the following: grape, yellow and cherry tomatoes.

It is generally recognised that there is a trend toward smaller size packaging, considering that there are many smaller sized households. Smaller size packaging also creates the need for more trips to the supermarket or grocery store, which is a goal of retailers and a trend among shoppers who are enamored with freshness willing to make a trip to the supermarket or grocery store two or three times a week.

Previous attempts have been made to fabricate compartmentalized containers designed specifically for the fresh produce industry. These containers however typically include one or more detachable dividers which are accommodated within a receptacle. As such, they have the disadvantage of being cumbersome to handle and lacking stability, particularly during transportation.

It is an object of the present invention to provide a produce container which may overcome or ameliorate the abovementioned disadvantage, or which will at least provide a useful alternative.

BRIEF SUMMARY

According to the present invention, there is provided a dual compartment produce container having a mouth circumscribed by a rim, the container including:

a first receptacle partially defined by a first wall;

a second receptacle partially defined a second wall; and a lid associated with the container to close off the mouth;

wherein the first and second walls are located opposite each other and joined at one end forming a barrier between the first and second receptacles Preferably, the first and second walls are disposed such that they converge towards to the joining end. More preferably, each wall includes a plurality of vertical ribs protruding outwardly of the receptacle. Each rib is preferred to include tapering sides converging upwardly towards the joining end and ends with a return at an opposite end following the curve of a round edge of the base of the receptacle. Even more preferably, each rib is in register with a corresponding rib protruding from the opposite wall. It is preferred that each rib is so configured that it abuts the corresponding rib at least at one point or along its entire length. As such, each rib has the dual function of reinforcing the wall from which it protrudes and preventing the receptacles from being squashed against each other.

Optionally, each wall includes a horizontal rib. Preferably, the horizontal rib protrudes outwardly of the receptacle. More preferably, the horizontal rib protruding from the first receptacle is in register and contact with that protruding from the second receptacle. As such, the horizontal ribs prevent the receptacles from being squashed against each other.

Preferably, the lid has a roof bounded by a wall arrangement to define a volume and a transition defined between the wall arrangement and the roof. More preferably, the transition is curved. Even more preferably, the transition is substantially convex when viewed externally of the container.

In a preferred embodiment, each of the first and second walls extends upwardly beyond the mouth of the container into the volume defined by the wall arrangement of the roof. It is preferred that where the first and second walls join is in close proximity to or contact with the roof of the lid. As such, the barrier is preferred to be capable of blocking off passage between the first and second receptacles. The barrier preferably has two rounded shoulders conforming to the shape of the transition and wall arrangement of the lid. More preferably, each shoulder is set back from the wall arrangement of the lid so as to allow air circulation between the receptacles.

BRIEF DESCRIPTION OF THE FIGURES

The invention may be better understood from the following non-limiting description of preferred embodiments, in which.

DETAILED DESCRIPTION OF VARIOUS EMBODIMENTS

It should be noted that the dual compartment produce container described herein is made of transparent plastic which is deformable when a substantial external force is applied thereto.

Figure 1:
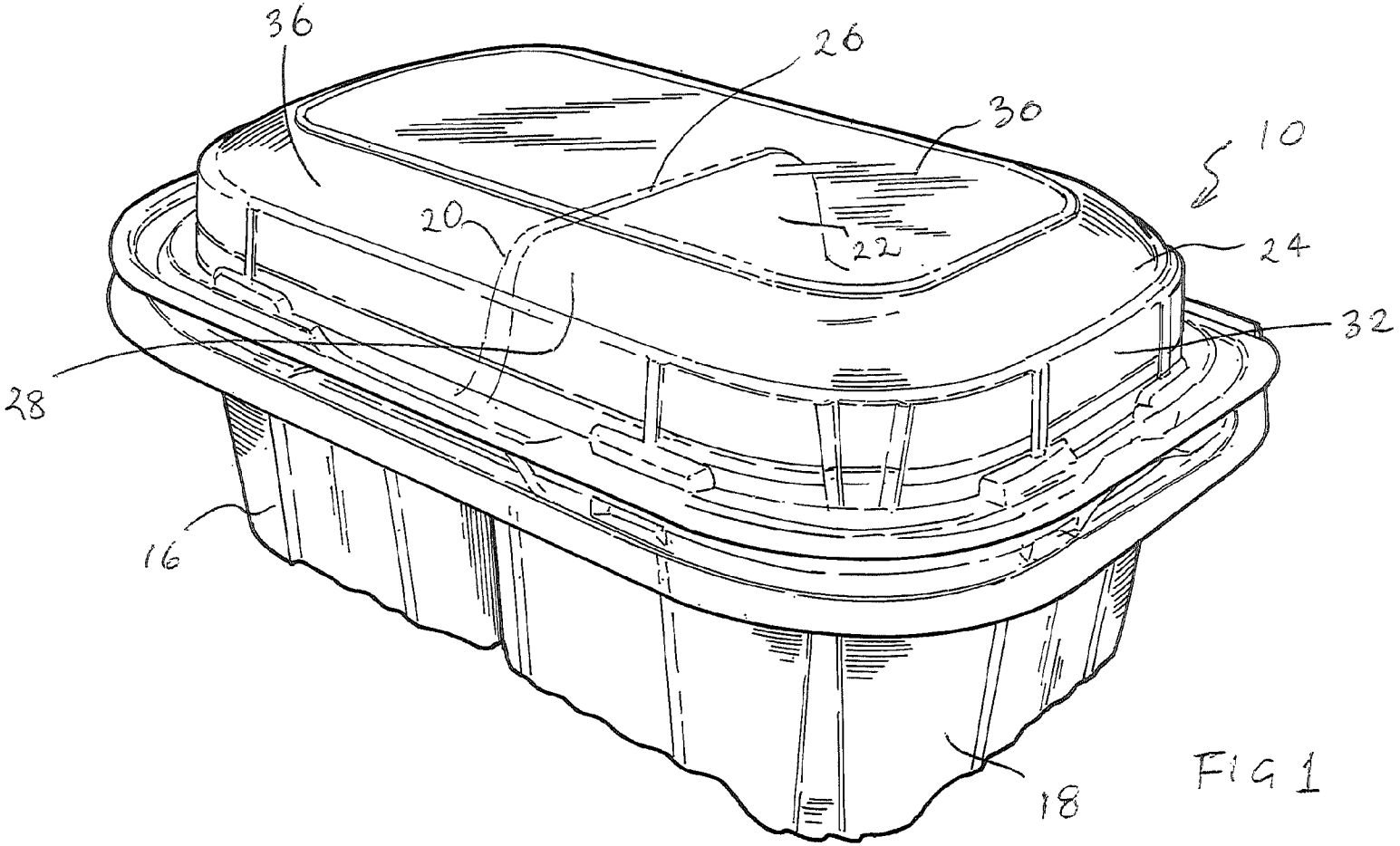
FIG. 1 is a top perspective view of a dual compartment produce container in a closed state in accordance with one preferred embodiment of the present invention.
Figure 2:
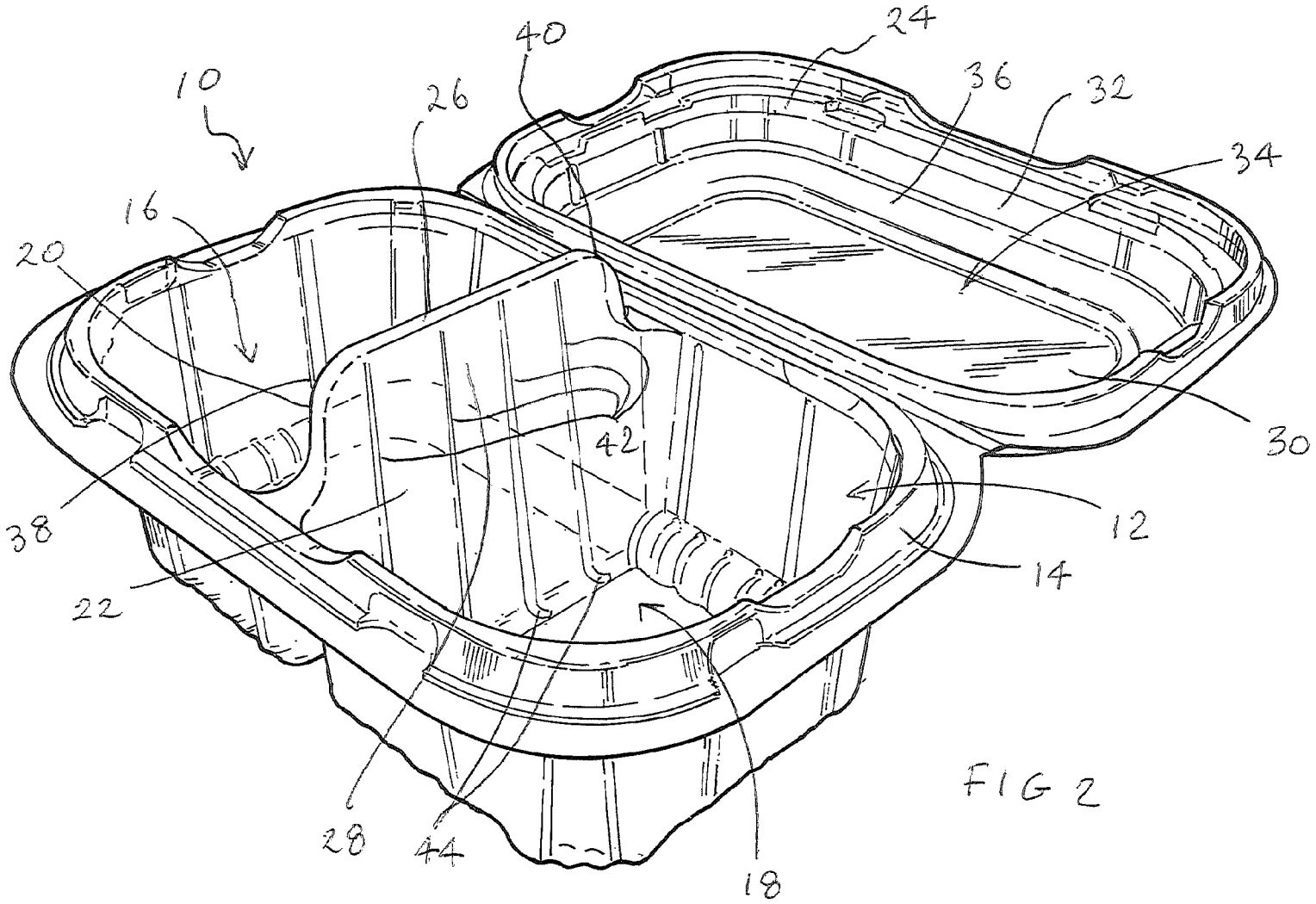
FIG. 2 is a top perspective view of the produce container of FIG. 1 in an open state.

Referring to FIGS. 1 and 2, a dual compartment produce container 10 is shown with a mouth 12 circumscribed by a rim 14. The container 10 has a first receptacle 16 partially defined by a first wall 20 and a second receptacle 18 partially defined a second wall 22. There is also a lid 24 associated with the container 10 to close off the mouth 12.

As shown in FIGS. 1 to 6, the first and second walls 20 and 22 are located opposite each other and joined at one end 26 forming a barrier 28 between the first and second receptacles 16 and 18. As best shown in FIGS. 3 to 6, the first and second walls 20 and 22 are disposed such that they converge towards to the joining end 26.

Referring to FIGS. 1, 2, 5 and 6, the lid 24 has a roof 30 bounded by a wall arrangement 32 to define a volume 34 (refer specifically to FIG. 2) and a transition 36 defined between the wall arrangement 32 and the roof 30. The transition 36 is curved and substantially convex when viewed externally of the container 10.

Figure 5:
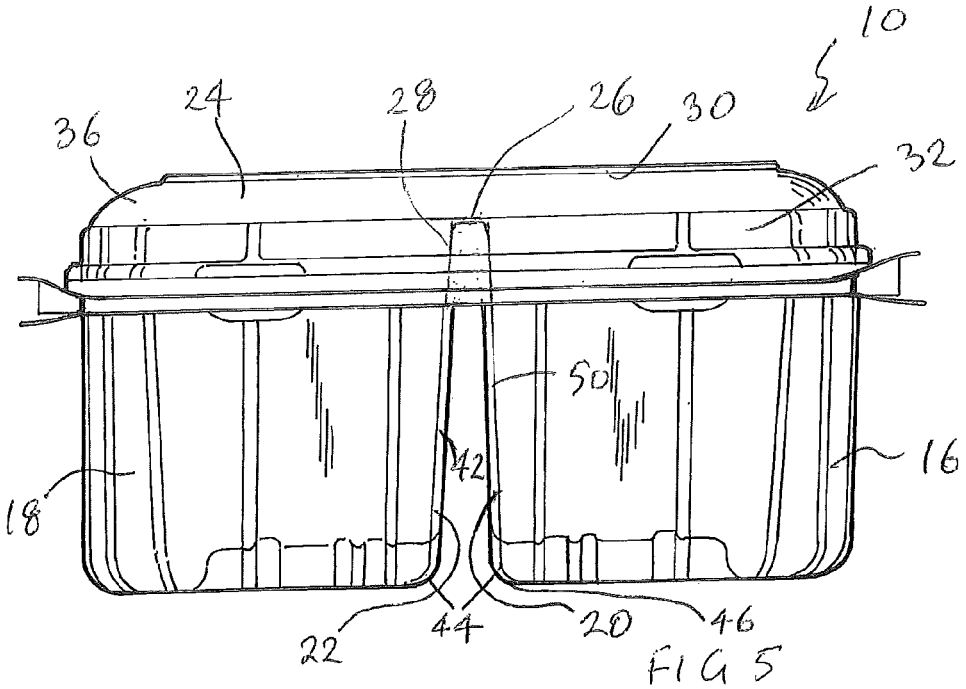
FIG. 5 is a rear view of the produce container of FIG. 1.
Figure 6:
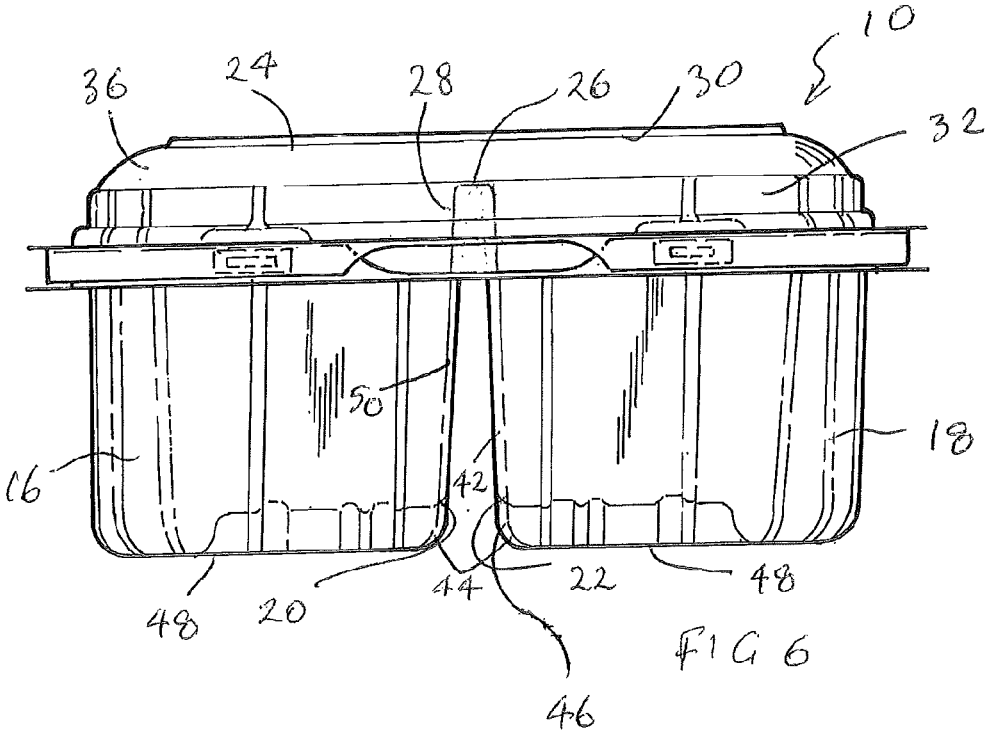
FIG. 6 is a front elevation of the produce container of FIG. 1.
Figure 7:
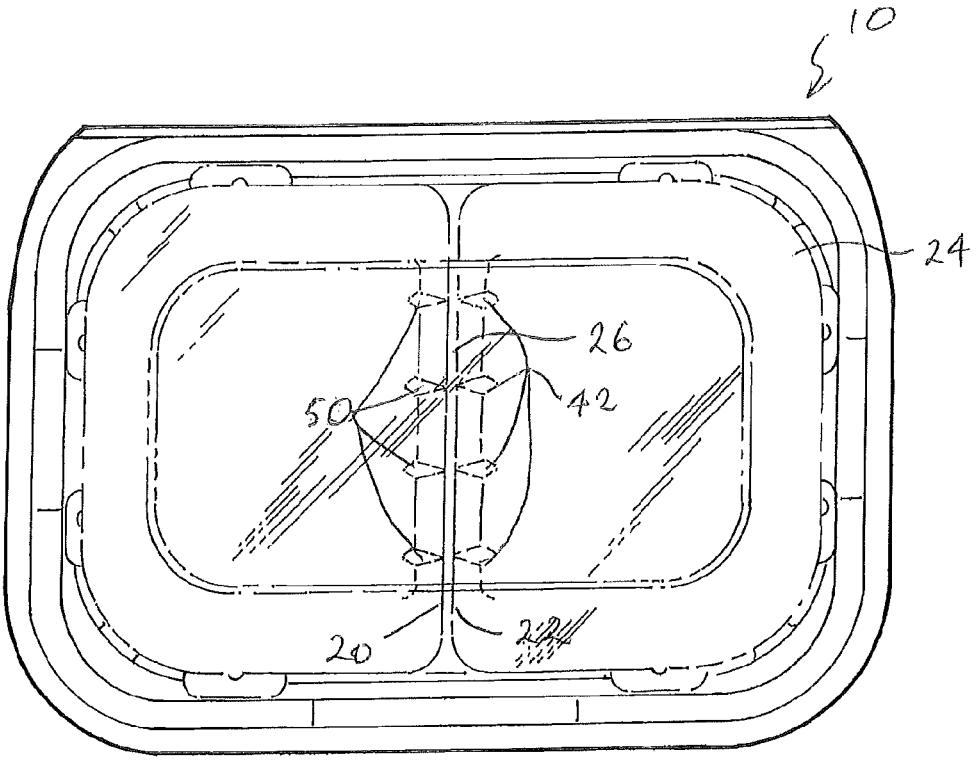
FIG. 7 is a top plan view of the produce container of FIG. 1.
Figure 8:
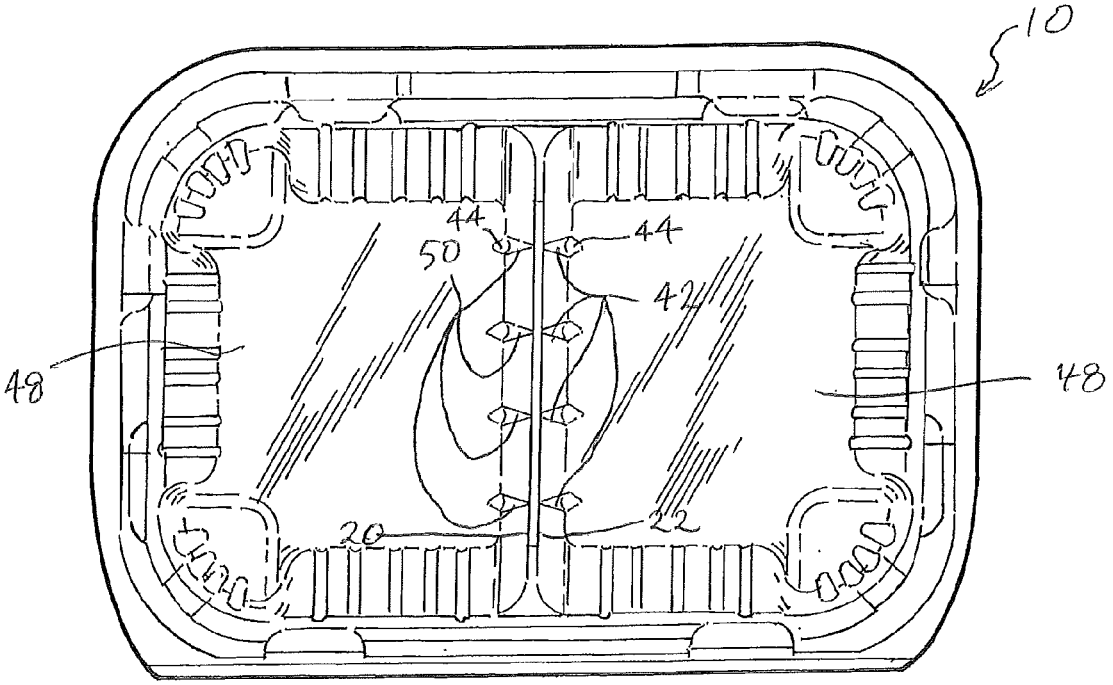
FIG. 8 is a bottom plan view of the produce container of FIG. 1.

Turning to FIGS. 2, 5 and 6, each of the first and second walls 20 and 22 extends upwardly beyond the mouth 12 of the container 10 into the volume 34 (see FIG. 2) defined by the wall arrangement 32 of the roof 30. As best shown in FIGS. 1, 5 and 6, where the first and second walls join is in close proximity to the roof 30 of the lid 24. The barrier 28 is capable of blocking off passage between the first and second receptacles. As such, when in use, for example, cherry tomatoes contained within receptacle 16 would be denied access to receptacle 18 where grape tomatoes are received and vice versa. This is advantageous particularly when containers are being knocked around during transportation or delivery from one location to another. As best shown in FIG. 2, the barrier 28 has two rounded shoulders 38 and 40 conforming to the shape of the curved transition 36 and wall arrangement 32 of the lid 24. Each shoulder 38, 40 is set back from the wall arrangement 32 of the lid 24 so as to allow air circulation between the receptacles 16 and 18.

Figure 3:
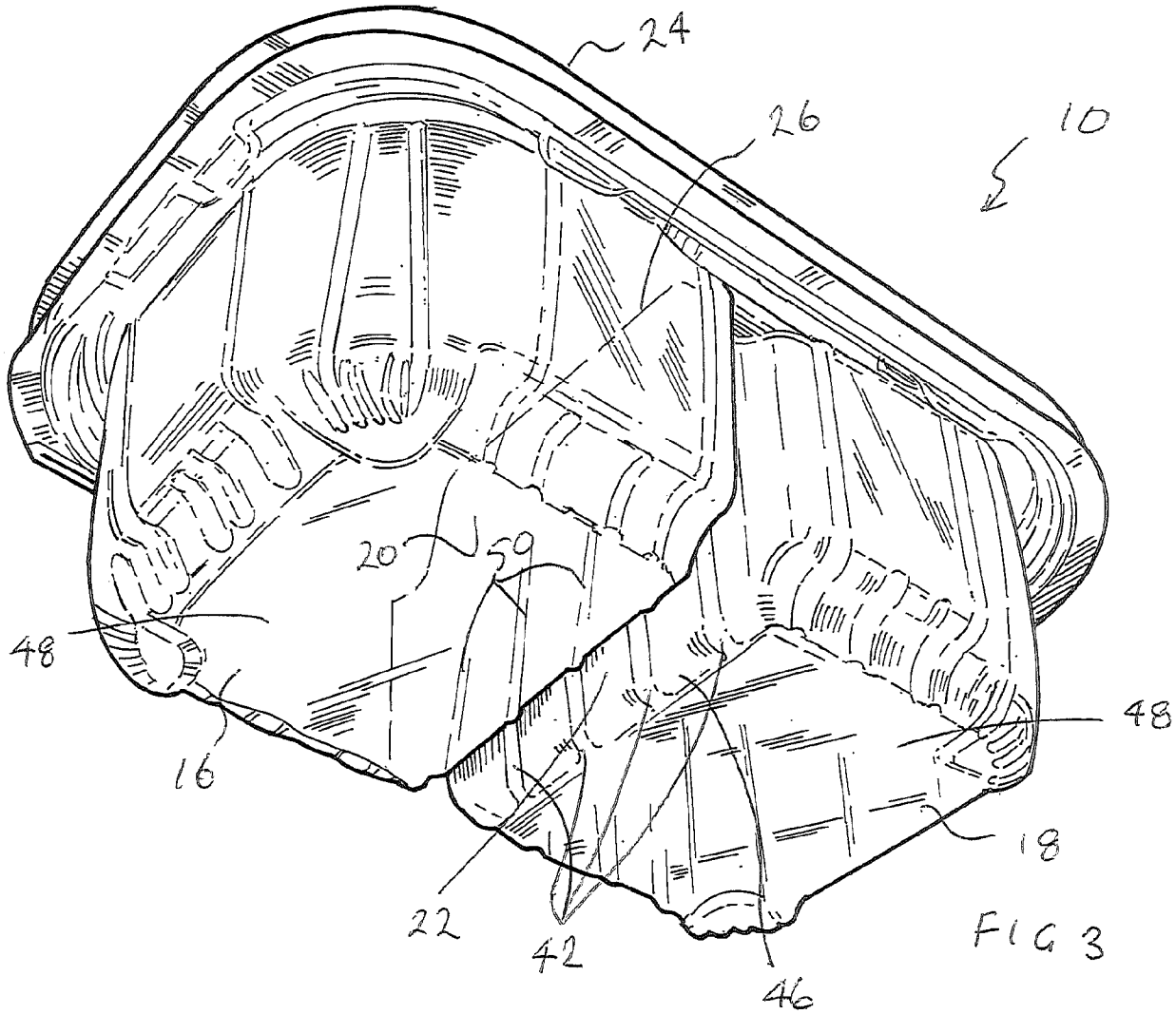
FIG. 3 is a bottom perspective view of the produce container of FIG. 1 in a closed state.
Figure 4:
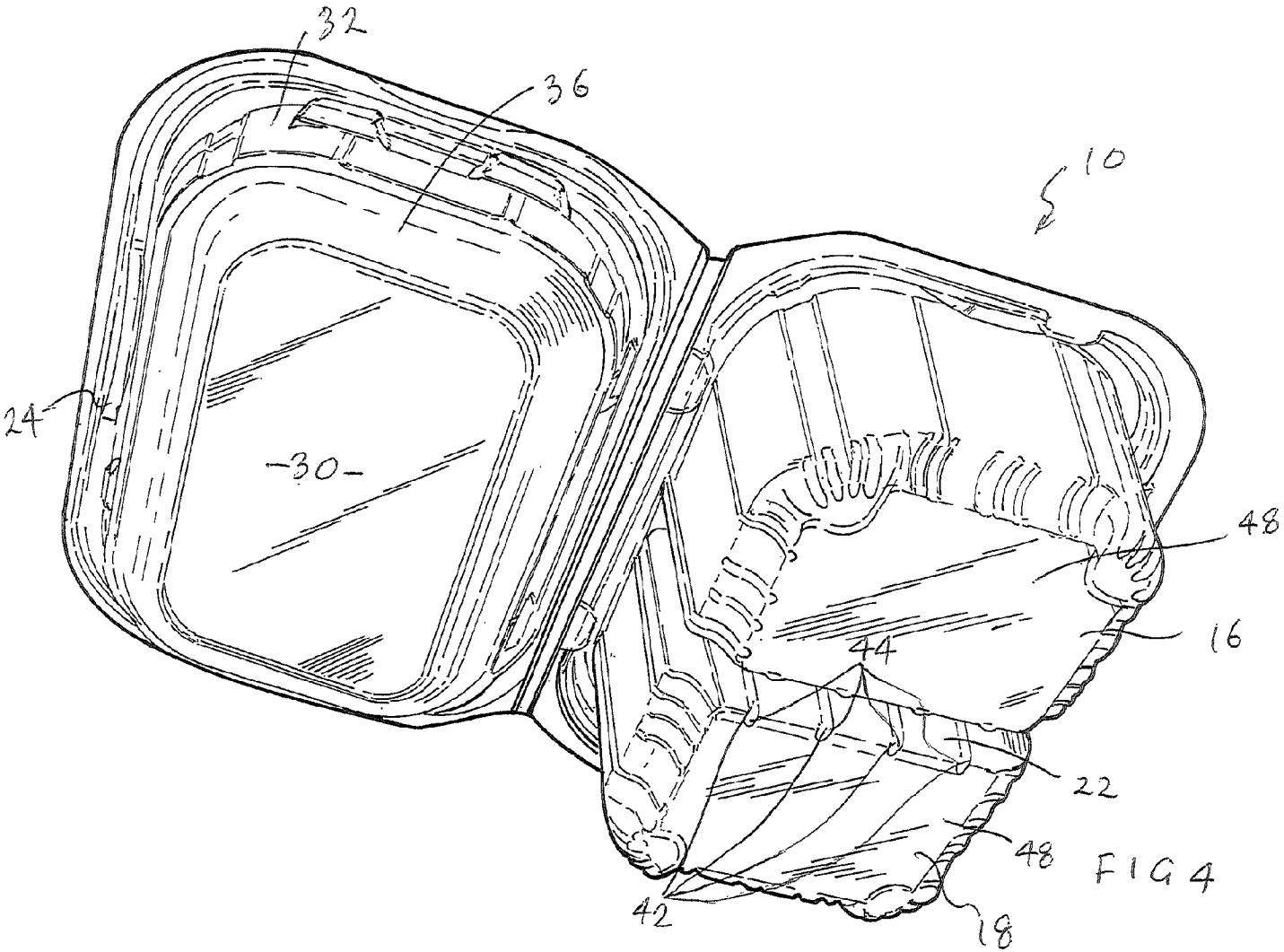
FIG. 4 is a bottom perspective view of the produce container of FIG. 1 in an open state.

Referring to FIGS. 2 to 4, each wall 20, 22 has a plurality of vertical ribs 42 protruding outwardly of each receptacle 16, 18. Each rib 42 has tapering sides converging upwardly towards the joining end 26 and ends with a return 44 at an opposite end (i.e., the bottom end) following the curve of a round edge 46 of the base 48 of each receptacle 16, 18. As best shown in FIGS. 3, 5 and 6, each rib 42 is in register with a corresponding rib 50 protruding from the opposite wall 20.

Figure 9:
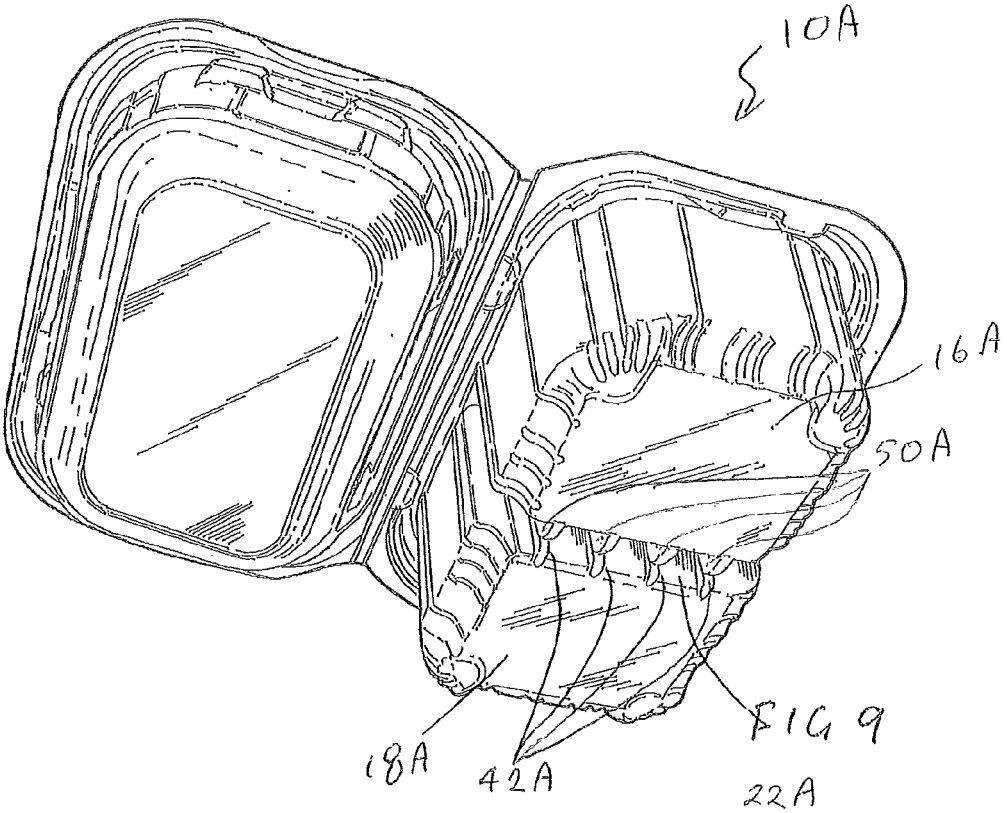
FIG. 9 is a bottom perspective view of a dual compartment produce container in an open state in accordance with another preferred embodiment of the present invention.
Figure 10:
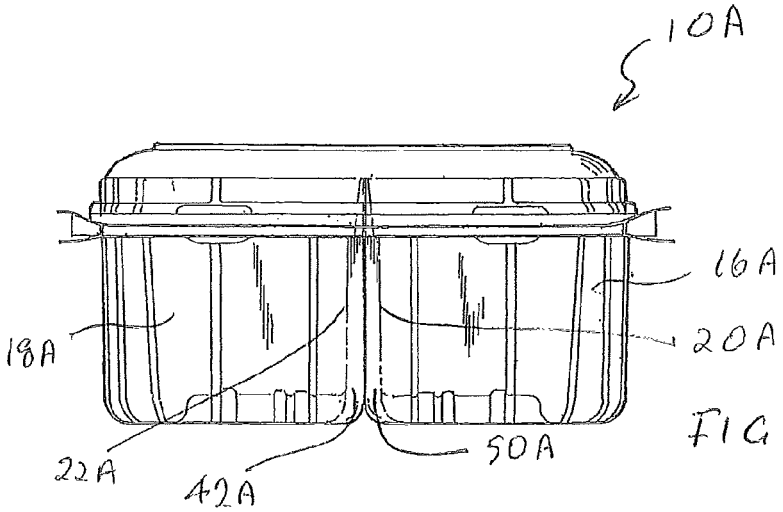
FIG. 10 is a rear view of the produce container of FIG. 9 being in a closed state.

Referring to FIGS. 9 and 10, another embodiment of the container 10A is shown with ribs 42A being so configured that they abut the corresponding ribs 50A along their entire length. As best shown in FIG. 10, each of the ribs 42A and 50A has an augmented thickness compared with those 42 and 50 provided in container 10 shown in FIGS. 1 to 8. As such, each rib 42A, 50A has the dual function of reinforcing the wall 20A, 22A from which it protrudes and preventing the receptacles 16A and 18A from being squashed against each other.

Figure 11:
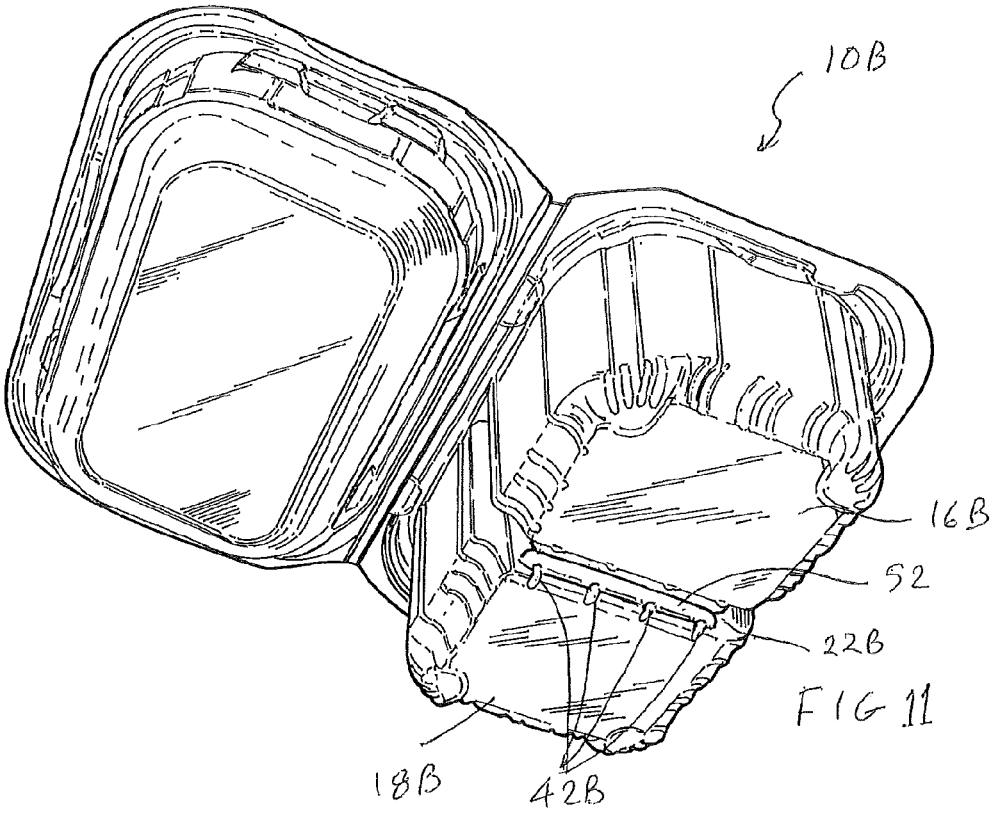
FIG. 11 is a bottom perspective view of a dual compartment produce container in an open state in accordance with a further preferred embodiment of the present invention.
Figure 12:
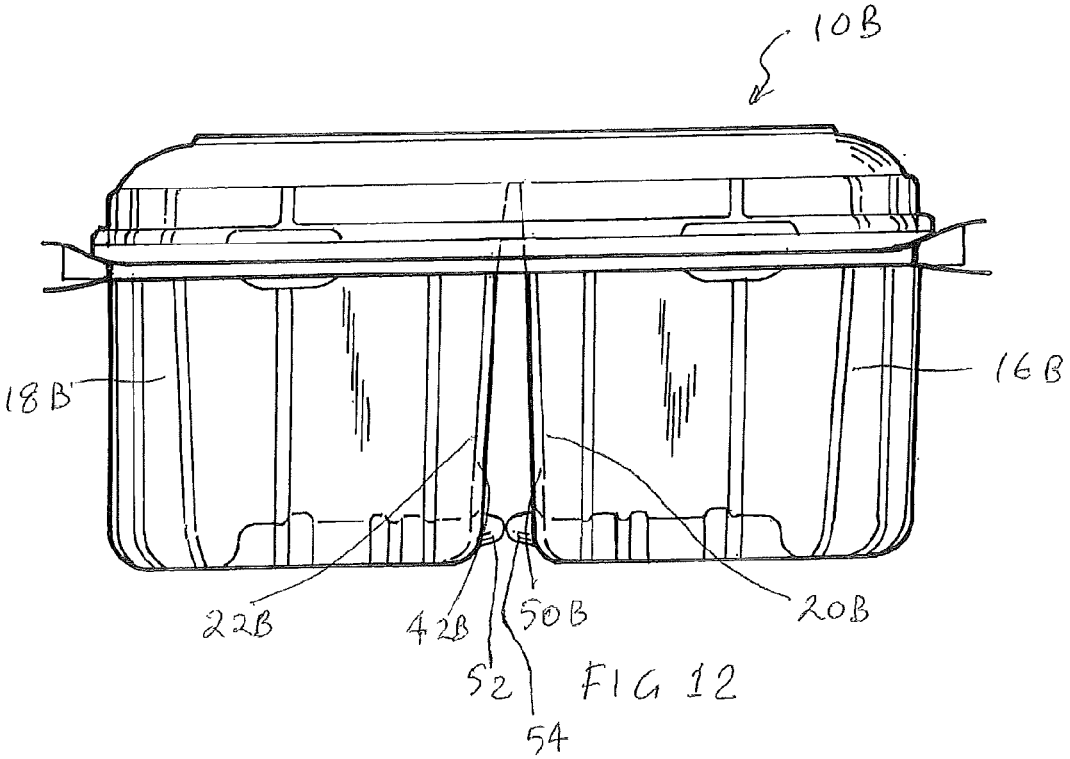
FIG. 12 is a rear view of the produce container of FIG. 11 being in a closed state.

Turning to FIGS. 11 and 12, a further embodiment of the container 10B is shown with ribs 42B and 50B being in the same configuration and size as those provided in container 10 shown in FIGS. 1 to 8. However, each wall 20B, 22B of this embodiment has a horizontal rib 52, 54 provided in the vicinity of the lower end of each receptacle 16,18. Each horizontal rib 52, 54 protrudes outwardly of the receptacle 16, 18. The horizontal rib 54 protruding from the first receptacle 16B is in register and contact with that 52 protruding from the second receptacle 18B. As such, the horizontal ribs 52 and 54 in combination prevent the receptacles 16B and 18B from being squashed against each other.

Now that a preferred embodiment of the present invention has been described in some detail, it will be apparent to a skilled person in the art that the dual compartment produce container of the present invention may offer at least the following advantages:

1. it enables two different kinds of produce to be contained in one contained but prevents unintentional mixing of the two kinds of produce; and 2. it includes vertical ribs which enhance the integrity of each receptacle, and horizontal ribs or augmented vertical ribs which prevent the two receptacles from being squashed against one another thereby reducing the likelihood of them being deformed.

Those skilled in the art will appreciate that the invention described herein is susceptible to variations and modifications other than those specifically described. For example, the ribs may be in different forms or shapes. Also, the angle of inclination of the walls 20 & 22 may vary. All such variations and modifications are to be considered within the scope and spirit of the present invention the nature of which is to be determined from the foregoing description.

The invention claimed is:

1. A dual compartment produce container having a mouth circumscribed by a rim, the dual compartment produce container comprising:

a first receptacle partially defined by a first wall;

a second receptacle partially defined a second wall; and a lid associated with the dual compartment produce container to close off the mouth;

wherein:

the first and second walls are located opposite each other and joined at one end, so as to define a barrier between the first and second receptacles;

the lid has a roof bounded by a wall arrangement to define a volume; and each of the first and second walls extends upwardly beyond the mouth of the dual compartment produce container into the volume defined by the wall arrangement of the roof.

2. The dual compartment produce container of claim 1, wherein the first and the second walls are disposed such that the first and the second walls converge towards to the one end at which the first and the second walls are joined.

3. The dual compartment produce container of claim 1, wherein each wall comprises a plurality of vertical ribs protruding outwardly of the first and second receptacles.

4. The dual compartment produce container of claim 3, wherein each rib comprises tapering sides converging upwardly towards the one end at which the first and the second walls are joined, and ends with a return at an opposite end following the curve of a round edge of a base of the first and second receptacles.

5. The dual compartment produce container of claim 3, wherein each rib is in alignment with a corresponding rib protruding from the opposite wall.

6. The dual compartment produce container of claim 5, wherein each rib is configured to abut the corresponding rib at least at one point or along its entire length.

7. The dual compartment produce container of claim 1, wherein each wall comprises a horizontal rib.

8. The dual compartment produce container of claim 7, wherein the horizontal rib protrudes outwardly of the receptacle.

9. The dual compartment produce container of claim 8, wherein the horizontal rib protruding from the first receptacle is in register and contact with that protruding from the second receptacle.

10. The dual compartment produce container of claim 1, wherein the lid has a transition defined between the wall arrangement and the roof.

11. The dual compartment produce container of claim 10, wherein the transition is curved.

12. The dual compartment produce container of claim 10, wherein the transition is substantially convex when viewed externally of the dual compartment produce container.

13. The dual compartment produce container of claim 10, wherein the barrier defined by the first and the second walls and between the first and the second receptacles has two rounded shoulders conforming to the shape of the transition and wall arrangement of the lid.

14. The dual compartment produce container of claim 13, wherein each shoulder is set back from the wall arrangement of the lid so as to allow air circulation between the receptacles.

15. The dual compartment produce container of claim 1, wherein where the one end at which the first and the second walls are joined is at least one of in close proximity to or contact with the roof of the lid.

* * * * *